United States Patent [19]

Siggia

[11] 4,037,897

[45] July 26, 1977

[54] VERTICALLY INDEXED DRAWER GUIDE SUPPORT STRIP

[75] Inventor: Edward P. Siggia, Armonk, N.Y.

[73] Assignee: Edward P. Siggia Inc., Mamaroneck, N.Y.

[21] Appl. No.: 548,234

[22] Filed: Feb. 10, 1975

[51] Int. Cl.[2] ..... A47B 88/04; A47F 5/00

[52] U.S. Cl. ..... 312/343; 211/190; 248/262; 308/3.6; 312/350

[58] Field of Search ..... 211/103-104, 211/176, 94, 94.5, 190, 193, 204, 208; 248/243, 261, 262, 265; 312/340-345, 257 SK, 349-351; 16/90, 96 D; 308/3.6; 403/230; 108/108, 109

[56] References Cited

U.S. PATENT DOCUMENTS

| | | | |
|---|---|---|---|
| 620,648 | 3/1899 | Goldsmith | 248/262 |
| 1,324,537 | 12/1919 | Belcher | 108/108 |
| 1,845,686 | 2/1932 | Stewart | 248/265 |
| 2,238,288 | 4/1941 | Richardson | 248/262 |
| 2,594,571 | 4/1952 | Lundberg | 312/350 X |
| 3,087,764 | 4/1963 | Schless | 312/345 X |
| 3,133,768 | 5/1964 | Klakovich | 308/3.6 |
| 3,263,821 | 8/1966 | Klene et al. | 211/190 |
| 3,658,399 | 4/1972 | Vogt | 312/343 |

FOREIGN PATENT DOCUMENTS

| | | | |
|---|---|---|---|
| 1,346,778 | 11/1963 | France | 211/176 |

*Primary Examiner*—Casmir A. Nunberg
*Attorney, Agent, or Firm*—Curtis Ailes

[57] ABSTRACT

A support strip adapted to be mounted on a desk or cabinet panel and to provide support for drawer guides which are conventionally used to support a drawer for sliding movement within a desk or cabinet enclosure.

14 Claims, 5 Drawing Figures

VERTICALLY INDEXED DRAWER GUIDE SUPPORT STRIP

BACKGROUND, OBJECTS AND SUMMARY OF THE INVENTION:

The present invention relates to devices for supporting drawer guides and the like and, more particularly, to a device in the form of a unitary continuous strip adapted to support channel-shaped drawer guides. The invention is particularly useful with metal drawer guides having a shallow U-shape cross-section of the type commonly used with nylon rollers for ease of operation. Such drawer guides are frequently used in wooden cabinets and desks.

A variety of desks and cabinets (hereinafter referred to generically as cabinets) are manufactured today with drawer guide hardware including metal drawer guides which may conveniently be supported on the front and back panels of such cabinet. In some cases the support member on the rear wall or panel is in the form of a plastic socket or the like which is fastened in the appropriate place on the rear wall and into which the end of the drawer guide can be inserted.

A difficulty with the above-described socket arrangement is that each of the individual sockets must be carefully oriented and aligned on the rear wall in order that the drawers will remain level and will operate properly, that is, without having a twist imposed on the drawer by the drawer guide. Therefore, it will be appreciated that the proper alignment of the sockets constitutes a time consuming assembly problem.

Accordingly, it is a important object of the present invention to facilitate the assembly of support members for supporting drawer guides or the like by establishing the proper orientation and alignment for the support of an entire group of drawer guides in one simple operation.

It is another important object of the invention to provide a unitary drawer guide support member which fits inside the rear wall of a cabinet for supporting an entire vertical row of drawer guides, and which is automatically self-indexed to the correct elevation position within the cabinet.

It is another important object of the present invention to provide a unitary drawer guide support member in the form of a continuous strip defining the required support members for one or more drawer guides and providing the inherent function that each drawer guide may be selectively mounted at different convenient elevation intervals which are less than the end dimensions of the drawer guide without moving the support member.

Another important object of the present invention is to provide a guide support member in the form of a continuous strip which may be easily shortened to a selected length to provide the required support member for one or more drawer guides, and in which each incremental length provides for selective mounting of a drawer guide at different convenient elevation intervals.

The present invention overcomes the drawbacks and deficiencies of the prior art as alluded to and fulfills the objects heretofore recited. To achieve these ends, a principal feature of the present invention provides a continuous mounting or support strip adapted to be mounted on the back wall of a cabinet, such support strip having a combination of a vertical channel and horizontally extending slots spaced at appropriate intervals along the length of the vertical channel, this combination serving together to provide the structural equivalent of U-shaped sockets for the drawer guides.

In the preferred embodiment to be described these intervals have been chosen to be ½ inch, but they could be selected to be much smaller, for example a quarter of an inch or less. The typical width for the end of the drawer guide is one inch so that in the case of ½ inch spacing between the aforenoted slots, the slot spacing is one half the end width of the drawer guide. This is extremely convenient in adjusting the drawer guide height at the time of assembling the cabinet and particularly the drawers thereof.

A further advantage that results from the construction of the present invention is that a minimum amount of material is necessary in providing the equivalent of the prior art U-shaped sockets. Thus, the only elements required are thin flanges for defining a vertical channel, and the aforenoted horizontal slots for proper support against vertical movement. This advantage will be apparent as the description proceeds.

Yet another advantage of the present invention is that the support strips, which may be composed of metal or preferably of molded plastic material, may also include portions of reduced thickness, between which portions a particular desired length of mounting strip can be retained and the rest of the strip can be broken off.

Other and further objects, advantages and features of the present invention will be understood by reference to the following specification in conjunction with the annexed drawings, wherein like parts have been given like numbers.

Figure 1:
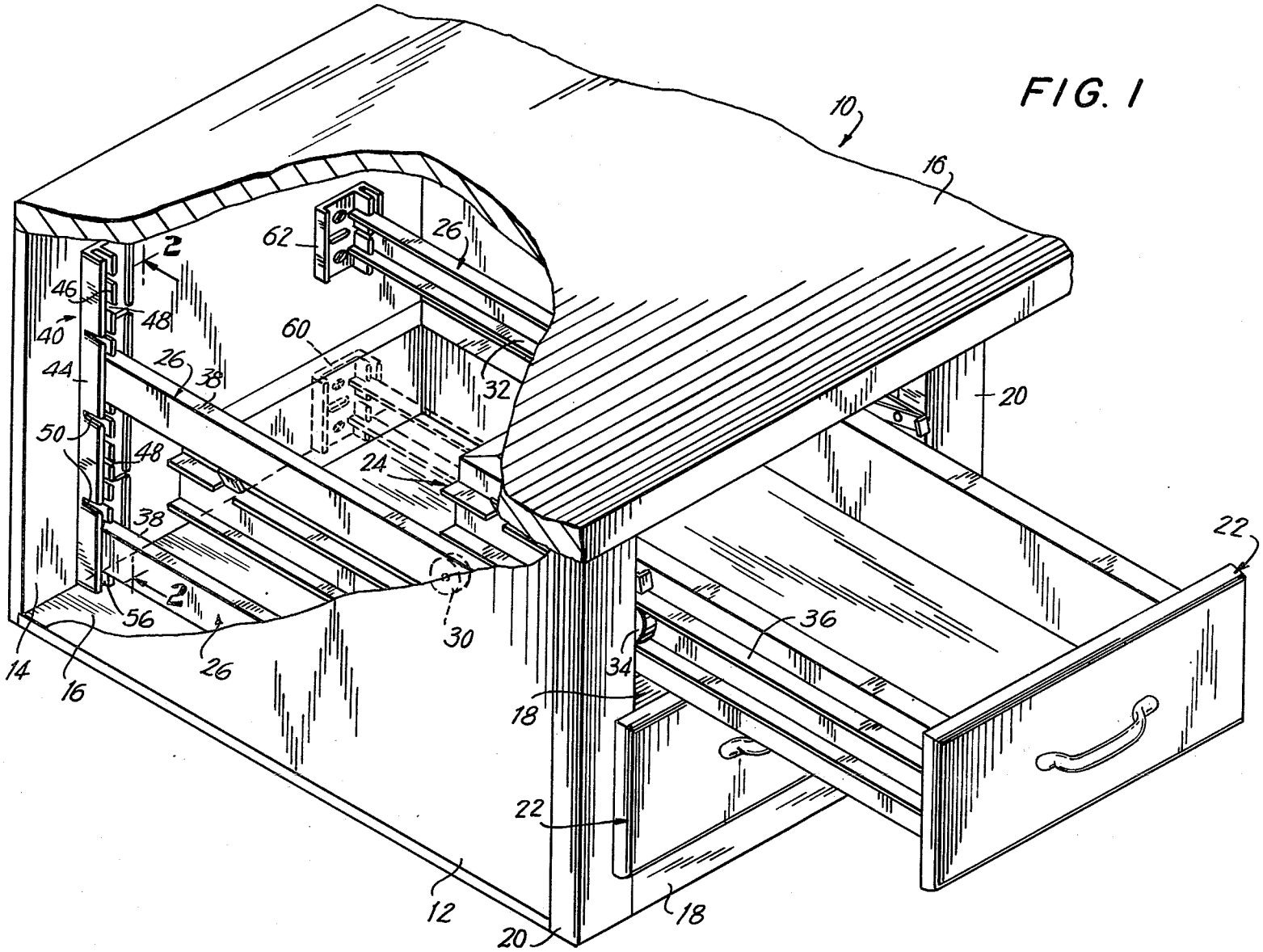
FIG. 1 is a perspective view of a typical cabinet in which the device of the present invention is incorporated.
Figure 2:
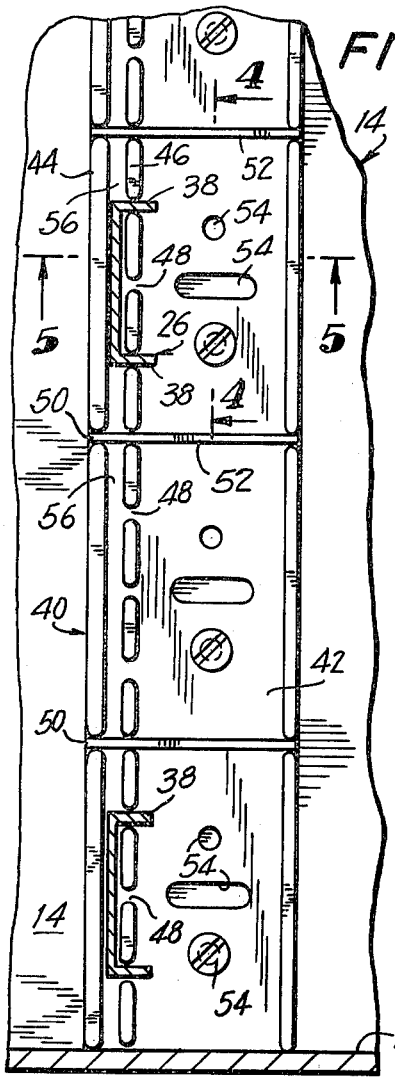
FIG. 2 is a front elevational view of one of the mounting strips of the present invention.
Figure 3:
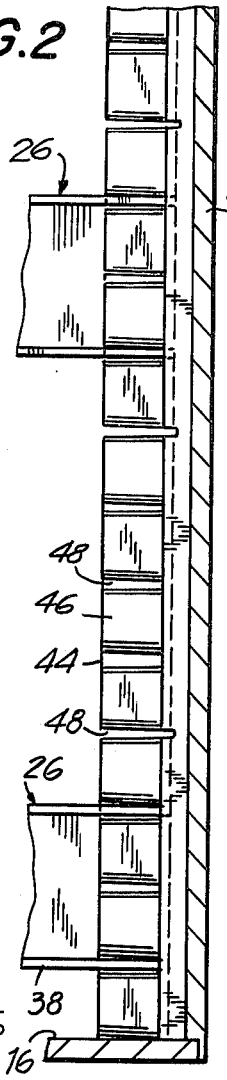
FIG. 3 is a side view of such mounting strip.
Figure 4:
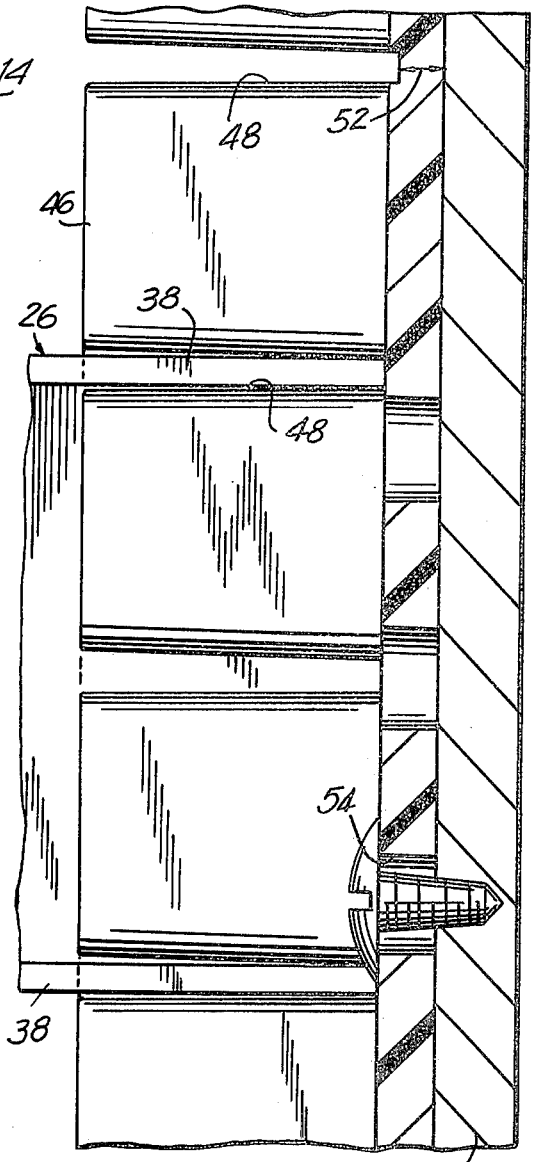
FIG. 4 is an enlarged sectional view taken on the line 4—4 of FIG. 2.
Figure 5:
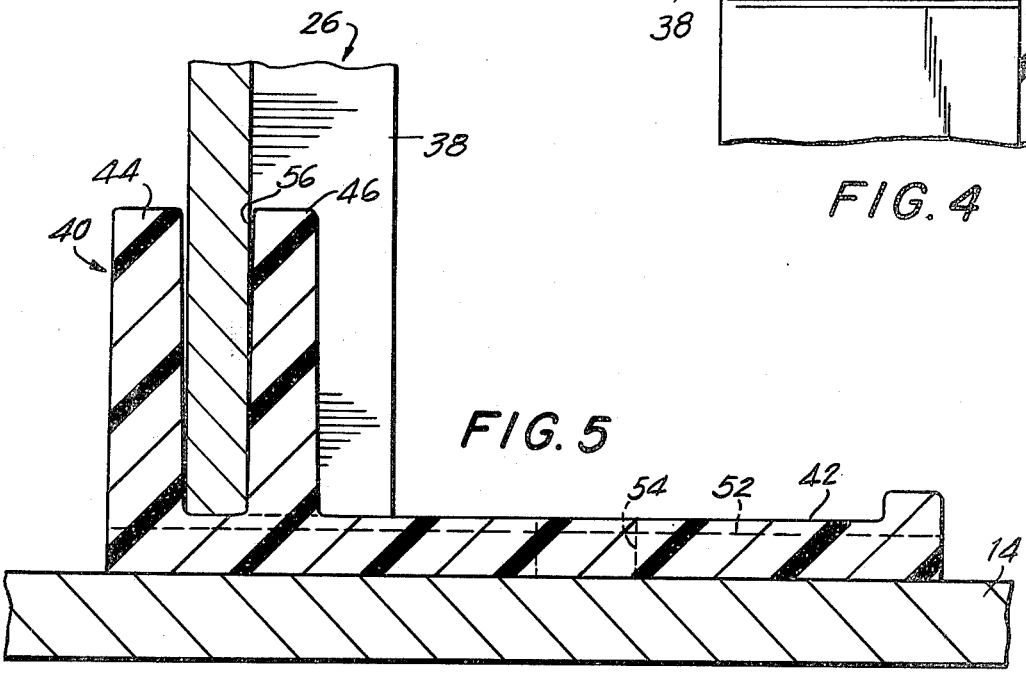
FIG. 5 is an enlarged sectional view taken on the line 5—5 of FIG. 2.

DESCRIPTION OF PREFERRED EMBODIMENT:

Referring in detail to the preferred embodiment depicted in the drawings, and particularly to FIG. 1, a cabinet 10 will be seen which includes side walls 12, rear wall 14 and bottom and top walls 16; at the front there are cross members 18 and upright members 20 defining openings for receiving drawers 22.

The discrete volumes between the cross members 18 and the upright members 20 within the interior serve as compartments or enclosures for the individual drawers. One of these drawers 22 is shown in FIG. 1 extended from its normal diposition in the upper compartment. This drawer is supported in its horizontal movement by means of a pair of upper drawer guides 24, one of which is seen, and by a pair of lower drawer guides 26. The other drawer is similarly supported.

The upper drawer guides 24 are attached to the drawers 22 and mounted below these guides are suitable brackets carrying rollers 30, which are adapted to travel along the flanges 32 of lower guides 26. At the front end of lower guides 26, other suitable brackets are mounted to carry rollers 34 which are engaged by the upper legs 36 of guides 24. The guides 24 and 26 are each U-shaped or channel shaped in cross-section.

At the rear wall 14 of cabinet 10, there is shown a preferred embodiment of the mounting or support strip 40 in accordance with the present invention, the details of which may be appreciated by reference to FIGS. 2-5. This support strip is preferably formed of a plastic or a synthetic resin material such as a polystyrene or an ABS resin. The support strip has a web or body portion 42 and, extending perpendicular to the web 42, a pair of parallel spaced flanges 44 and 46. Flange 46 is provided with slots 48 at intervals of ½ inch. Flange 44 has slots 50 every 2 inches. The 2 inch spacing for slots 50 is for the purpose of permitting the strip to be quickly and easily broken off to any desired length at two inch intervals when desired. For the same reason, as will be especially seen in FIGS. 2 and 3, the thickness of the web 42 is reduced in correspondingly spaced narrow portions 52.

The web 42 is preferably provided with preformed mounting holes 54, and web 42 is thus adapted to be secured in abutting relationship against the rear cabinet wall 14, with the result that the flanges 44 and 46 will project inwardly of the enclosure or space. It will also be seen by reference to FIG. 2 that drawer guides 26 have their end body portions retained at different elevations in a channel 56 defined by the flanges 44 and 46 and that the legs 38 of the guides 26 are retained within the slots 48 formed in flange 46.

A complete vertical row of a large number of drawers in a cabinet can be served by just two of the drawer guide support strips 40 of the present invention. These support strips are very easily vertically aligned by assembling them with their bottom edges placed against the bottom panel 16 of the enclosure accommodating such vertical row. The individual drawer guides conforming to the construction of guide 26 are then simply inserted at the appropriate levels required for that particular vertical row of drawers.

Since the support strip 40 is very easily and conveniently broken off to achieve the desired length (within plus or minus 2 inches), it may preferably be fabricated in the longest length which is expected to be required. For instance, in cabinets of desk height, a 26-inch length is the longest which is normally needed. Accordingly, in a shallow 2-drawer cabinet such as illustrated in FIG. 1, only four 2-inch segments totaling 8 inches in length may be required. The remainder of the strip may be simply broken off and used in another location.

Furthermore, as illustrated at 60, if only one drawer is to be supported in the cabinet, or if it is desired to minimize in the utilization of the strip material, a single 2-inch section 60 of the strip may be employed to support the bottom drawer guide, and if a second drawer is provided, a second 2-inch strip section may be provided for that purpose, as indicated at 62.

While two different modes of utilization of the strip 40 are illustrated in FIG. 1 in order to exemplify the various ways in which the strip may be employed, the installation would normally be symmetrical. That is, in the preferred form of the invention two 8-inch strips would be used at the back panel 14 for supporting all of the four drawer guides. However, if the short 2-inch sections were used for individually mounting the drawer guides, as illustrated at 60 and 62, then the left-hand drawer guides would also be mounted with individual 2-inch sections.

Referring again to FIGS. 2, 3, 4 and 5, and particularly to FIGS. 4 and 5, all of the openings in the mounting strip 40, such as the channel 56 and the slots 48 in the flange 46 are provided with a draft or taper. This provides the combined advantage that it promotes the production of the strip by plastic molding techniques, and that it also provides for a combination of ease of insertion of the end of the drawer guide 26 into the channel 56 and the slots 48, but with a tightening effect as the drawer guide is inserted fully to the bottom of the openings.

While specific dimensions have been referred to in the disclosure, it will be understood that other dimensions and other variations in details may be employed.

The support strip of the present invention is adapted to accommodate a variety of drawer guides of conventional construction. Such drawer guides are, for example: Model KV-1300 from Knape & Vogt Manufacturing Company, Grand Rapids, Michigan; Model 336 from Grant Pulley & Hardware Corporation, West Nyack, New York.

What has thus been provided by the present invention, in the context of supporting a drawer in a cabinet by means of a drawer guide, is the combination of that guide with a continuous support strip which minimizes the use of material in supporting the drawer guide, such strip being adapted to be mounted on the back wall or panel of the cabinet. Such support strip features a vertical channel defined by spaced parallel flanges upstanding from a web or body portion, and a plurality of slots spaced along the length of one of the flanges so that the channel and slots permit easy height adjustablility for the drawer guides at small intervals, such intervals being less than the end dimensions of the drawer guide.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. In a drawer support construction in which a U-shaped cross-section drawer guide is adapted to provide for sliding movement of a drawer in a cabinet, the drawer guide being at least partially supported by a support member fastened to the rear wall of such cabinet, the improvement comprising an improved support member in the form of a support strip including a web; and a pair of spaced parallel vertical flanges perpendicular to said web, said flanges defining a channel for receiving the end of the central body portion of the U-shaped cross-section drawer guide, one of said flanges including a series of horizontally extending slots spaced along the length of said one flange for receiving and accommodating the two legs of the U-shape at the end of said drawer guide for support of said end of said drawer guide.

2. A construction as defined in claim 1, in which said support strip extends continuously so as to accommodate drawer guides at different selected heights within a cabinet enclosure depending upon which slots accommodate said legs.

3. A construction as defined in claim 1, in which said slots in said one flange are spaced at intervals less than the space between the legs of said drawer guide.

4. A construction as defined in claim 3, in which said intervals are ½ inch and the space between legs is 1 inch.

5. A construction as defined in claim 3, in which said other flange is provided with slots at predetermined intervals and said web is provided with corresponding reduced thickness portions, whereby an extended support strip can be reduced in length by increments corresponding to such predetermined intervals by separation at said reduced thickness portions.

6. A construction as defined in claim 3, in which said flanges of said U-shaped drawer guide have all of their terminal edges lying in a single plane.

7. A support device adapted to support one end of a U-shaped cross-section drawer guide or the like, comprising a support strip including a web portion adapted for attachment of the support strip for mounting vertically within a cabinet;

a pair of spaced parallel flanges perpendicular to said web, said flanges defining a channel for receiving the end of the central body portion of the U-shaped cross-section drawer guide, one of said flanges including a series of substantially full depth transverse slots spaced along the length thereof for accommodating the two legs of the U-shape at the end of said drawer guide.

8. A device as defined in claim 7, in which said support strip extends continuously so as to accommodate drawer guides at different heights within a cabinet enclosure.

9. A device as defined in claim 7, in which said slots in said one flange are spaced at intervals less than the space between the legs of said drawer guide.

10. A device as defined in claim 9, in which said intervals are ½ inch and the space between said legs is 1 inch.

11. A device as defined in claim 10, in which the other flange is provided with slots at predetermined intervals and with corresponding reduced thickness portions for said web, whereby an extended support strip can be reduced in length by increments corresponding to such intervals by separation at said reduced thickness portions.

12. A device as defined in claim 10, in which said channel shaped drawer guide has all of its terminal edges lying in a single plane.

13. A construction as claimed in claim 3, in which the spaces between said parallel flanges and the spaces formed by said slots in said flanges are tapered so as to be narrower at the bottom to thus provide for ease of insertion and snug support of said drawer guide.

14. A construction as claimed in claim 13, in which said support strip consists essentially of a molded synthetic resin material.

* * * * *